US005873142A

United States Patent [19]

Theiss

[11] Patent Number: 5,873,142

[45] Date of Patent: Feb. 23, 1999

[54] LANCE HEAD

[75] Inventor: Scott M. Theiss, Lake Lure, N.C.

[73] Assignee: Framatome Technologies, Inc., Lynchburg, Va.

[21] Appl. No.: 822,277

[22] Filed: Mar. 20, 1997

[51] Int. Cl.[6] ..... F22B 37/52

[52] U.S. Cl. ..... 15/316.1; 165/95; 122/390; 239/DIG. 13

[58] Field of Search ..... 15/415.1, 316.1, 15/317, 318, 318.1; 165/95; 122/390, 391, 392; 239/DIG. 13

[56] References Cited

U.S. PATENT DOCUMENTS

| | | | |
|---|---|---|---|
| 1,970,401 | 8/1934 | Snow | 15/316.1 |
| 1,995,133 | 3/1935 | Snow et al. | 15/317 |
| 2,897,532 | 8/1959 | Cantieri | 15/317 |
| 4,422,882 | 12/1983 | Nelson et al. . | |
| 5,063,632 | 11/1991 | Clark et al. | 15/316.1 |
| 5,194,217 | 3/1993 | St. Louis et al. . | |
| 5,230,306 | 7/1993 | Barringer et al. . | |
| 5,241,723 | 9/1993 | Garrabrant . | |
| 5,379,727 | 1/1995 | Kling et al. | 15/316.1 X |
| 5,505,163 | 4/1996 | Jameel . | |
| 5,509,607 | 4/1996 | Booher et al. . | |

FOREIGN PATENT DOCUMENTS

| | | | |
|---|---|---|---|
| 625.642 | 8/1927 | France . | |
| 946274 | 5/1949 | France | 15/316.1 |

*Primary Examiner*—Chris K. Moore
*Attorney, Agent, or Firm*—Rhodes Coats & Bennett, L.L.P.

[57] ABSTRACT

A lance tube formed of a tubular conduit having an inner end to be joined to a source of pressurized fluid, a closed distal end, a continuous wall between the inner and distal ends, and a plurality of tube discharge openings in the continuous wall; and a plurality of axially positioned fluid direction tubes within the conduit, each tube having a straight intake section generally axially aligned with the conduit and having an intake opening toward the conduit inner end, a straight discharge section having a discharge opening at one of the discharge openings in the conduit wall, and an intermediate curved section joining the intake and discharge sections, whereby fluid entering the conduit will be directed through the fluid direction conduits, and will be discharged in laminar flow from the discharge openings.

12 Claims, 1 Drawing Sheet

LANCE HEAD

BACKGROUND OF THE INVENTION (1) Field of the Invention

The present invention relates generally to an apparatus for cleaning sludge and other particles from heat exchanger surfaces and, more particularly, to a fluid discharge lance head of the type that is used for cleaning the heat exchanger surfaces of steam generators, e.g., nuclear steam generators.

(2) Description of the Prior Art

Steam generators, such as are found in nuclear power stations, generate steam used to drive turbines by heating water with heat exchangers. These heat exchangers are comprised of bundles of tubes with a heated liquid flowing therethrough. Steam is generated by water contacting the outer surfaces of the heat exchangers. The high temperatures and severe operating conditions incurred during steam generation cause sludge and other particles to accumulate on the surfaces of the heat exchangers, reducing heat transfer efficiency. Therefore, it is the practice to periodically remove accumulated deposits.

Sludge removal is normally effected using a device known as a lance connected to a source of pressurized fluid, e.g., water, steam or a gas. The lance may be permanently located in the generator, but is usually inserted through an opening is the generator wall when the heat exchanger surfaces are to be cleaned, and removed after cleaning.

The lance is normally comprised of a main tubular section or conduit having an inner end connected to a source of pressurized liquid, and a distal end that is closed. At least one, and generally a plurality, of nozzles or openings are located in the conduit wall between the inner and distal ends of the conduit for the purpose of discharging jets of liquid from the conduit interior into the steam generator and against the surfaces of the heat exchangers. Impact of the liquid, as a result of its physical force, normally removes a large percentage of the particles from the heat exchanger surfaces.

In some instances, however, the removal efficiency is less than desired, particularly when the position of the heat exchanger surfaces prevent the lance nozzles from being placed close to the surfaces. This lower efficiency is due to the fact that the force of the cleaning liquid decreases dramatically over even distances of a few inches. It has been recognized in the prior art that this loss in force, or jet decay, is primarily attributable to turbulence of the fluid exiting the lance nozzle.

Various attempts have been made in the prior art to reduce this turbulence, i.e., to produce discharge streams that are more laminar in nature, by different designs of the lance, and in particular the lance nozzle configuration. For example, U.S. Pat. Nos. 5,230,306 to Barringer et al; 5,241,723 to Garrabrant; and 5,505,163 to Jameel, all describe lance nozzle constructions that are said to improve the coherence and force of the discharge jet. The structures described in these patents, however, still do not provide optimum force.

Thus, there remains a need for a new and improved lance which improves the flow characteristics of the fluid being discharged from the lance onto heat exchanger surfaces in a steam generator while, at the same time, is simple to construct and use.

SUMMARY OF THE INVENTION

The present invention is directed to a lance comprised of a tubular conduit having an inner end to be joined to a source of pressurized fluid, and a distal end that is normally closed. At least one, and preferably a plurality, of fluid discharge openings are located in the conduit wall between the inner and distal ends. In order to produce fluid discharges with less turbulent flow, and thus greater force, the lance also importantly includes at each opening a fluid direction tube having a discharge end joined to the opening, an inlet end in the direction of the conduit inner end, and a central, curved tubular section between the inlet and discharge ends. Each inlet of each fluid direction tube is offset from the adjacent, upstream tube to further reduce turbulence, thereby increasing the flow characteristics of the fluid being discharged from the lance.

Accordingly, one aspect of the present invention is to provide a lance tube for cleaning a steam generator or the like, the tube including: (a) a tubular conduit having an inner end to be joinable to a source of pressurized fluid; a closed distal end; a continuous wall between the ends; and at least one fluid discharge opening in the wall; and (b) at least one fluid direction tube having a discharge end joined to the discharge opening; an inlet directed toward the conduit inner end; and a central, curved tubular section between the inlet and discharge ends.

Another aspect of the present invention is to provide a fluid direction tube for providing laminar flow from the nozzles of a lance tube, the tube including: (a) a straight intake section of between about ⅛" to 1" in length; (b) a straight discharge section of between about ⅛" to 1" in length; (c) an intermediate curved section joining the intake and discharge sections at an angle of curvature of between about 30° to 90°; and (d) wherein the ratio of the centerline radius of the intermediated curved section to the inside diameter of the fluid direction tube is between about 6 to 12.

Still another aspect of the present invention is to provide a lance tube for cleaning a steam generator or the like, the tube including: (a) a tubular conduit having an inner end to be joinable to a source of pressurized fluid; a closed distal end; a continuous wall between the ends; and at least one fluid discharge opening in the wall; (b) a plurality of fluid direction tubes having a discharge end joined to the discharge opening; an inlet directed toward the conduit inner end; and a central, curved tubular section between the inlet and discharge ends, wherein the ratio of the centerline radius of the intermediated curved section to the inside diameter of the fluid direction tube is between about 6 to 12; and (c) wherein the inlet section of each fluid direction tube is radially or otherwise offset from the inlet section of the adjacent, upstream tube to reduce turbulence.

These and other aspects of the present invention will become apparent to those skilled in the art after a reading of the following description of the preferred embodiment when considered with the drawings.

DESCRIPTION OF THE PREFERRED EMBODIMENTS

Figure 1:
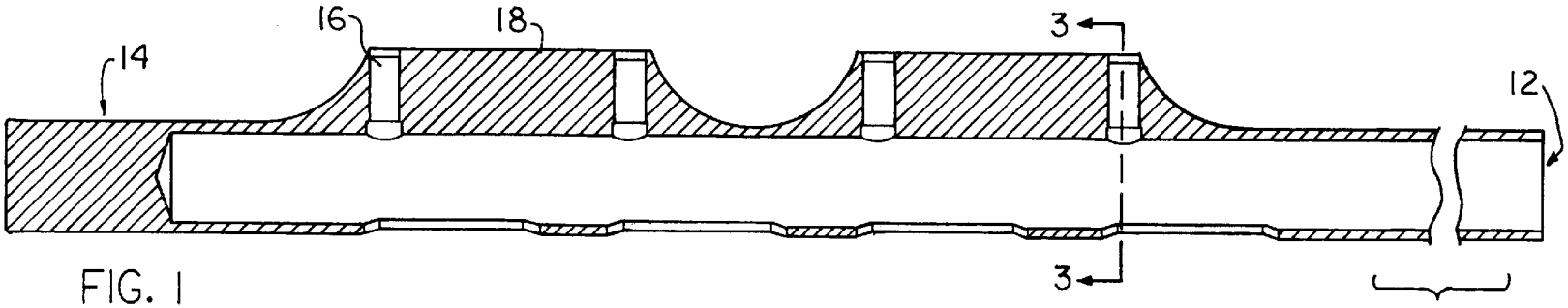
FIG. 1 is sectional side view of a lance conduit without any fluid direction tubes.

In the following description, like reference characters designate like or corresponding parts throughout the several views. Also in the following description, it is to be understood that such terms as "forward", "rearward", "left", "right", "upwardly", "downwardly", and the like are words of convenience and are not to be construed as limiting terms.

Figure 2:
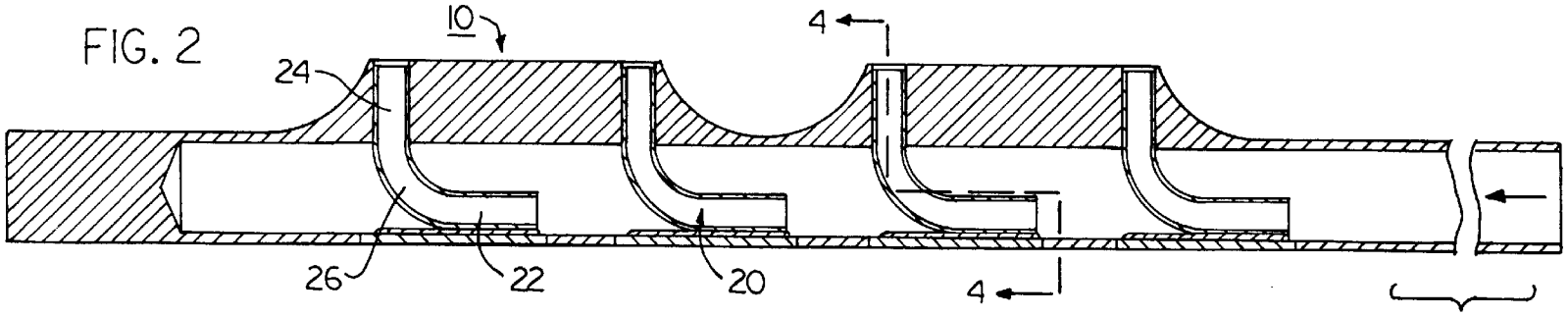
FIG. 2 is a sectional side view of a lance conduit with fluid direction tubes inserted constructed according to the present invention.
Figure 4:
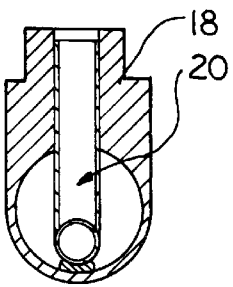
FIG. 4 is a cross-section of the lance conduit of FIG. 2, along line 4—4.
Figure 3:
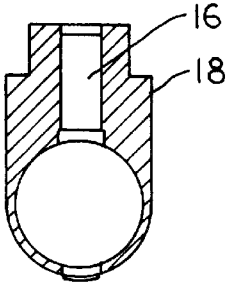
FIG. 3 is a cross-section of the lance conduit of FIG. 1, along line 3—3.

Referring now to the drawings in general and FIG. 1 in particular, it will be understood that the illustrations are for the purpose of describing a preferred embodiment of the invention and are not intended to limit the invention thereto. As best shown in FIG. 2, the lance of the present invention, generally designated 10, is comprised of a tubular conduit, generally 10, has an inner end 12 which is joined during use to a source of pressurized fluid (not shown) and a closed distal end 14.

Conduit 10 is about 2" in length with an inner diameter of at least ¼". Tube discharge openings 16, having a diameter of between about 1/16" to 3/16", are located in conduit wall 18 between ends 12 and 14.

In the preferred embodiment, a fluid direction tube 20 is associated with each tube discharge opening 16. Each tube 20 is comprised of straight intake section 22, which is between about ⅛" to 1" in length; a straight discharge section 24 of between about ⅛" to 1" in length; and an intermediate curved section 26 with a centerline radius of curvature of between about 6 to 12 times the inside diameter of the tube, which is between about 0.040" to 0.125" joining the intake and discharge sections at an angle of between about 30° to 90°. The actual length of each fluid direction tube 20 in order to ensure laminar flow has been found to be irrelevant if the radius of curvature and inside diameter are chosen according to the present invention.

For most purposes, the lance will include a plurality, e.g., between about 2 to 8 discharge openings equally spaced along the conduit, e.g., between about ½" to 1½" apart. In lance configurations using more than one discharge opening, and thus more than one fluid direction tube, turbulence may be created at the inlet of a fluid direction tube inlet due to the presence of another fluid direction tube directly ahead the fluid inlet of the downstream fluid direction tube, i.e., between the fluid direction tube and the inner end of the lance conduit. Thus, in an especially preferred embodiment of the invention, the inlet sections of each tube are offset from the inlet section of any immediately preceding or upstream tube, so that there is non-turbulent flow into the inlet opening of the fluid direction tube. This offset may be achieved by transversely bending the downstream tube by between about 5 to 20 degrees. Preferably, however, the discharge openings in the conduit wall are offset from any immediately preceding opening by between about 5 to 10 degrees.

The lance may be constructed by drilling discharge openings into the wall of a conduit at the desired angle, with the openings having an interior diameter equal to the exterior diameter of the fluid direction tubes. The side of the conduit into which the openings are made may be of a greater thickness than the rest of the conduit wall in order to reinforce the openings. Temporary openings are then made on the opposite side of the conduit wall for use in inserting the fluid direction tubes.

A fluid direction tube is then fitted to each opening, with the end of the tube discharge section being inserted into the discharge opening in the conduit, and the intake section of the fluid direction tube being axially aligned with the conduit bore, and pointed toward the conduit inner end. The fluid direction tube can then be fixed in place, e.g., by welding the discharge section to the conduit at the discharge opening. The temporary openings in the conduit are then covered.

In operation, a cleaning fluid, such as water, is forced into conduit 10. A portion of the fluid enters each fluid direction tube 20, and flows through sections 22, 26 and 24 of the tube, and is discharged as a laminar jet from the end of discharge section 24.

In prior art lances, the fluid is often required to take an abrupt right-hand turn into the discharge opening from the conduit bore. As a result, turbulence is created, and the force of the jet rapidly decays. In the present invention, on the other hand, the section of the stream being discharged from an opening first travels along a relatively lengthy pathway, and is smoothly moved around a curve substantially greater than the radius of the tube, thereby allowing the fluid to adapt a laminar flow. Thus, the fluid jet, when discharged, maintains its integrity for a longer period of time, travels a greater distance with greater force and results in more efficient cleaning of heat exchangers located at a distance from the lance.

Certain modifications and improvements will occur to those skilled in the art upon a reading of the foregoing description. By way of example, the entrance or exit of the tubes could be flared to improve flow characteristics. Also, the cross section of the tube could be elliptical or otherwise shaped. It should be understood that all such modifications and improvements have been deleted herein for the sake of conciseness and readability but are properly within the scope of the following claims.

I claim:

1. A lance tube for cleaning a steam generator or the like, said tube comprising:

(a) a tubular conduit having an inner end to be joinable to a source of pressurized fluid; a closed distal end; a continuous wall between said ends; and at least one tube discharge opening in said wall; and (b) at least one fluid direction tube having a discharge end joined to said discharge opening; an inlet directed toward the conduit inner end; and a central, curved tubular section between said inlet and discharge ends.

2. The apparatus according to claim 1, further including a plurality of fluid direction tubes, the inlet section of each fluid direction tube is offset from the inlet section of the adjacent, upstream tube to reduce turbulence.

3. The apparatus according to claim 1, wherein said fluid direction tube has a bore diameter of between about 0.040" to about 0.125".

4. The apparatus according to claim 1, including a plurality of discharge openings spaced axially along said conduit.

5. The apparatus according to claim 4, wherein said discharge openings are spaced at between about ½" to about 1½".

6. The apparatus according to claim 1, wherein the outlet end of said fluid direction tube is flush with the outer wall of said tubular conduit.

7. A fluid direction tube for providing laminar flow from the nozzles of a lance tube, said tube comprising:

(a) a straight intake section of between about ⅛" to 1" in length;

(b) a straight discharge section of between about ⅛" to 1" in length;

(c) an intermediate curved section joining the intake and discharge sections at an angle of curvature of between about 30° to 90°; and (d) wherein the ratio of the centerline radius of the intermediated curved section to the inside diameter of the fluid direction tube is between about 6 to 12.

8. A lance tube for cleaning a steam generator or the like, said tube comprising:

(a) a tubular conduit having an inner end to be joinable to a source of pressurized fluid; a closed distal end; a continuous wall between said ends; and at least one tube discharge opening in said wall;

(b) a plurality of fluid direction tubes having a discharge end joined to said discharge opening; an inlet directed toward the conduit inner end; and a central, curved tubular section between said inlet and discharge ends, wherein the ratio of the centerline radius of the intermediated curved section to the inside diameter of the fluid direction tube is between about 6 to 12; and (c) wherein the inlet section of each fluid direction tube is offset from the inlet section of the adjacent, upstream tube to reduce turbulence.

9. The apparatus according to claim 8, wherein said fluid direction tube has a bore diameter of between about 0.040" to about 0.125".

10. The apparatus according to claim 8, including a plurality of discharge openings spaced axially along said conduit.

11. The apparatus according to claim 10, wherein said discharge openings are spaced at between about ½" to about 1½" apart.

12. The apparatus according to claim 8, wherein the outlet end of said fluid direction tube is flush with the outer wall of said tubular conduit.

* * * * *